United States Patent [19]

Ptaschek et al.

[11] Patent Number: 5,009,058

[45] Date of Patent: Apr. 23, 1991

[54] AUTOMATIC BALING MACHINE

[75] Inventors: Lawrence Ptaschek, Roanoke; James Bowman, Salem; H. William Ferguson, Jr., Buchanan, all of Va.

[73] Assignee: NSW Corporation, Inc., Roanoke, Va.

[21] Appl. No.: 471,459

[22] Filed: Jan. 29, 1990

[51] Int. Cl.[5] ..... B65B 9/16; B65B 39/06

[52] U.S. Cl. ..... 53/469; 53/439; 53/525; 53/576; 53/577

[58] Field of Search ..... 53/459, 469, 577, 576, 53/575, 530, 529, 525, 437, 439

[56] References Cited

U.S. PATENT DOCUMENTS 2,656,658 10/1953 Grady ..... 53/577 X
3,380,220 4/1968 Jennings et al. ..... 53/439
3,940,906 3/1976 Leckband et al. ..... 53/577 X
4,446,677 5/1984 Kokido ..... 53/577
4,790,124 12/1988 Kaji ..... 53/576 X

FOREIGN PATENT DOCUMENTS 2403749 7/1975 Fed. Rep. of Germany ..... 53/183
2717609 10/1978 Fed. Rep. of Germany ..... 53/576

*Primary Examiner*—James F. Coan
*Attorney, Agent, or Firm*—Jeffrey P. Morris

[57] ABSTRACT

A device and method for baling a plurality of items in a sack-like bale enclosure which includes a conduit for conducting items from a conveyor to a sock-like item receptacle coaxially mounted over an outlet end of the conduit.

36 Claims, 7 Drawing Sheets

SS1
ES1
B
246
SET COUNT TO 0
248
POWER BELT MOTOR
250
POWER SHAKER MOTOR
252
COUNT BAGS
254
FULL COUNT?
NO
YES
256
STOP BELT MOTOR
258
STOP SHAKER MOTOR
260
ACTIVATE NET LOCK
262
TIME DELAY
264
PULL GATHERER IN
SS2
ES2
C

C
SS2
ES2
266
PROJECT CLINCHER HEAD OUT
268
PULL CLINCHER HEAD DOWN
270
LOCK CLINCHER HEAD
272
CLINCH NET
274
RAISE CLINCHER HEAD
276
CLINCH NET
278
CUT NET
280
OPEN CRADLE DOORS
282
TILT CRADLE FORWARD
284
KICK BAG OUT
SS3
ES3
D

D
286
CLOSE CRADLE DOORS
288
TILT CRADLE BACK
290
RETRACT CLINCHER HEAD
292
DEPRESS CYCLE STOP
294
CYCLE STOP?
NO
B
YES
296
STOP
SS3
ES3

AUTOMATIC BALING MACHINE

BACKGROUND OF THE INVENTION

1. Field of the Invention

The present invention relates to an automatic baling machine for baling products for shipping, and more particularly, to a computer controlled automatic baler which utilizes plastic net tubing as the baling material.

2. Description of the Prior Art

The use of plastic netting for packaging consumer products is well known and has been practiced for many years. Plastic netting is particularly appropriate for packaging fruits and vegetables because it allows air to circulate around the packaged produce. Thus, spoilage is prevented by allowing bacteria nurturing moisture o the surface of the produce to evaporate. Plastic netting is also economical, strong, and lightweight. Numerous patents have been granted relating to devices for making and filling net bags. Of particular pertinence is U.S. Pat. No. 3,380,220 to Jennings, et al. and British Patent No. GB 2 173 762 A to Cox. The patent to Jennings, et al. discloses a tree packaging method and apparatus utilizing a funnel which progressively constricts a Christmas tree to the size of a slide tube thereby enabling the tree to be passed through the slide tube. A tube-shaped polyethelene net wrap is disposed about the exterior surface of the slide tube and a free end thereof is tied to the trunk of the tree after it has been passed through the funnel but prior to its entrance into the slide tube, an access space being provided therebetween. The tree is then urged forward into the slide tube. As the tree passes through the slide tube, the netting is pulled from the exterior of the slide tube and into its center, thereby covering the tree in net wrap. When the tree emerges from the slide tube, the netting is bound above the top of the tree and the net severed beyond the binding, rendering an individually packed tree. The Jennings, et al method and device permits a tree, which is manually pushed through the Jennings, et al. device to be individually wrapped.

British Patent GB 2 173 762 A discloses a machine for packing fruits and vegetables into net bags constructed from tubular netting. The device has a pivoting, downwardly directed delivery tube for conducting produce into bag material disposed over one end of the tube. A supply of tubular netting for making up the produce bagging is disposed about an outer surface of the pendulous delivery tube towards the bottom of the tube. A friction ring provides for controlled dispensing of netting material during the bagging operation. An individual bag is formed by sealing the bottom end of the tubular netting by means of a sealer/cutter positioned in proximity to the bottom end of the pivoting delivery tube at a point along its arching path. A sealed bottom having been formed in the netting, the produce is directed through the delivery tube to the net bag which it fills. The bag is then sealed at the top by passing it through the sealer/ cutter a second time, the tensioning of the bagging about the fruit being assisted by a telescoping member which lengthens the arc distance traveled by the bottom end of the pivoting tube. After the top is sealed, the individual bag is cut free of the netting and the process begun again. The British device provides a means of packaging produce in quantities appropriate for sale in a supermarket.

Neither of the above-cited patents, nor any other prior art, includes an automated baler for baling a large quantity of items for shipping, such as a plurality of individual bags of produce. This function is now typically performed by a group of 2 to 4 workers who manually fill, seal, and palletize the large bales. No device is currently known for performing this function which does not require a significant input of human labor, which can continuously receive a plurality of items, as supplied by a conveyor belt, for example, bale them in a large bale for shipping, and offload the large bale.

SUMMARY OF THE INVENTION

The problems and disadvantages associated with the conventional techniques and devices utilized to bale a large quantity of items into a single large bale are overcome by the present invention which includes a device for baling a plurality of items in a sack-like bale enclosure formed from a tube of flexible material sealed at one end to yield a sock-like item receptacle which is filled with a selected number of items and additionally sealed distal to the first sealed end to enclose the items. The resultant bale is then cut from the remainder of the tube. The device includes a base and a conduit mounted thereon for conducting the items from an inlet at one end of the conduit to an outlet at the other end. The tube of flexible material is coaxially mountable on the outer surface of the conduit with the sealed end situated below the outlet for capturing items within the sock-like item receptacle. A dispenser control mechanism selectively dispenses lengths of the tube to be used for continuously forming bales.

BRIEF DESCRIPTION OF THE FIGURES

For a better understanding of the present invention, reference is made to the following detailed description of an exemplary embodiment considered in conjunction with the accompanying drawings, in which.

DETAILED DESCRIPTION OF THE FIGURES

Figure 1:
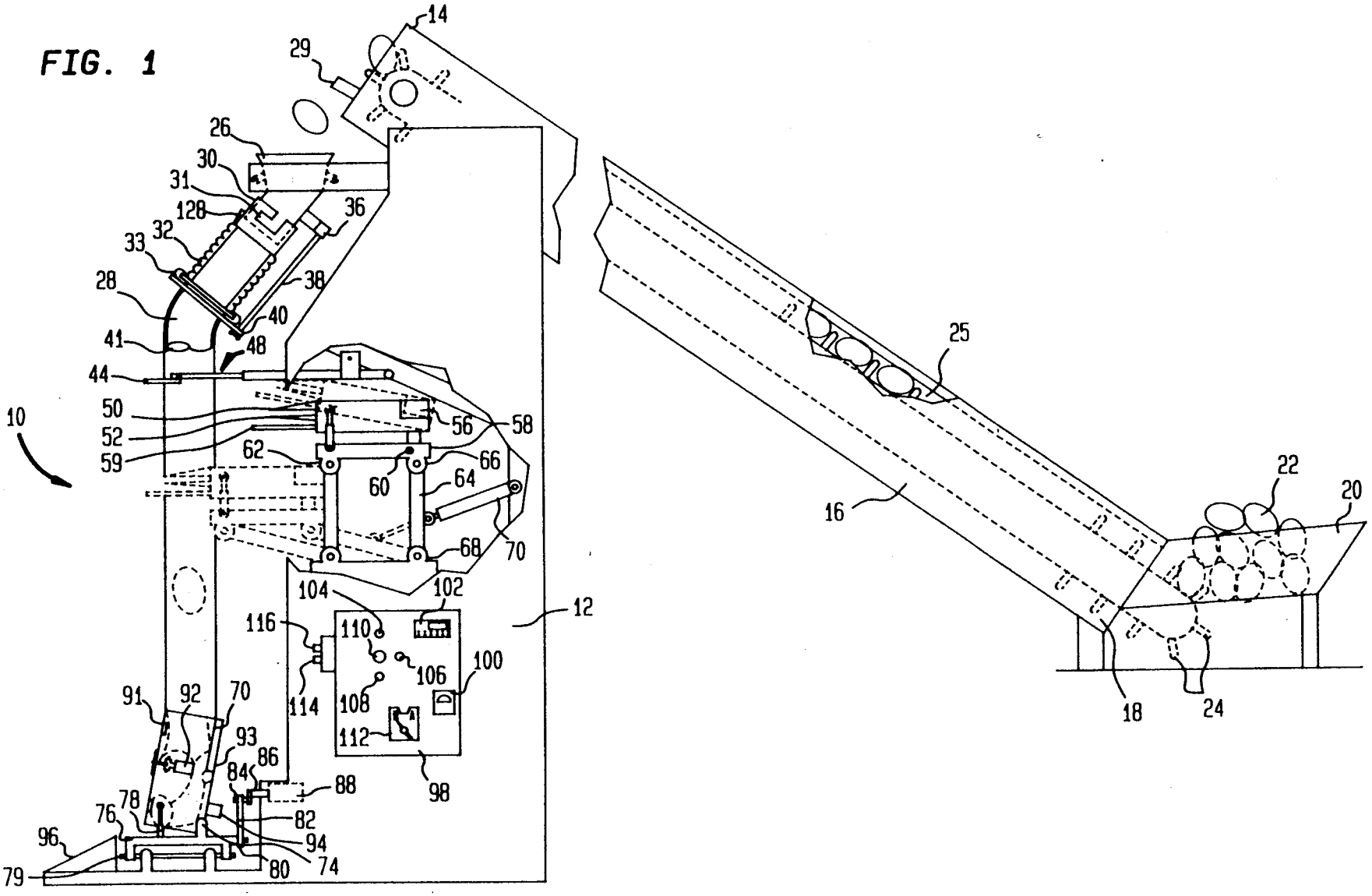
FIG. 1 is a side view in elevation of a device constructed in accordance with one exemplary embodiment of the present invention, in operation, and having partially filled a bale with a plurality of items.

Referring to FIG. 1, there is shown an automatic baler 10 having an upright base 12 which supports and elevates an upper end 14 of an inclined conveyor 16. The conveyor 16 communicates at its lower end 18 with the interior of a collection bin 20 which receives a plurality of items 22 therein. The collection bin 20 can be located at any level relative to ground level, but should be inclined as shown in FIG. 1, to induce the items 22 to slide towards the conveyor 16. The items 22 may be manually supplied to the collection bin 20 or by automated means, such as, an onload conveyor (not shown). The inclined conveyor 16 is provided with a plurality of staggered cleats or paddles 24 which capture and lift items 22 from the collection bin 20. The items 22 are carried by the cleats 24 to the upper end 14 of the inclined conveyor 16. A wall 25 is provided for bisecting the inclined conveyor 16 parallel to the direction of upward movement. In this view, the conveyor rotates in a counterclockwise direction to carry items 22 to the upper end 14 of the inclined conveyor 16. Upon reaching the upper end 14, the items 22 fall by gravity into a funnel-shaped receiver 26, and from there, into a feed sleeve 28. The wall 25, in conjunction with the staggering of the cleats 24, insures that only a single item 22 will be carried on a single cleat 24, and thus, only one item at a time will be fed into the feed sleeve 28. This single feeding arrangement permits an optical sensor 29 to individually sense each item dropped into the feed sleeve 28, and an accurate count of items 22 falling into the sleeve 28 can be maintained. The bifurcation of item flow can also be assisted by partitioning the collection bin 20 with a divider wall (not shown).

The feed sleeve 28 has a keyway 30 which slideably receives and locks onto a mating pin 31 protruding from the outer surface of the receiver 26 for holding the feed sleeve 28 and receiver 26 in removeable association. The feed sleeve 28 has a gathered or rucked net tube 32 installed thereover that is longitudinally bunched tightly on the feed sleeve 28 such that a very long net tube 32 can be accommodated on a relatively short feed sleeve 28. The net tube 32 is preferably composed of extruded polyethylene or an equivalent inexpensive, yet tough and flexible, material. An active clamp ring 33, in cooperation with a fixed clamp ring 34, releasably clamps the lower end of the net tube 32 therebetween and selectively permits lengths of net tubing 32 to be withdrawn from the feed sleeve 28 when appropriate. The net tubing 32 passes over the fixed clamp ring 34 and under the active clamp ring 33 (between the interior radius of the active clamp ring 33 and the exterior surface of the feed sleeve 28). A double acting clamp cylinder 36, affixed to the receiver 20, is driven by compressed air or the like, and actuates a clamp rod 38. The clamp rod 38 extends from the clamp cylinder 36 to the active clamp ring 33 where it passes through a suitable opening therein, and where it is secured to the active clamp ring 33 by a threaded wing nut 40, or the like. A matching double acting cylinder 36, clamp rod 38, etc., is preferably provided on an opposite side of the feed sleeve 28, to provide an even compression of the active clamp ring 33 against the fixed clamp ring 34. An alternative construction might employ a non-actuated, fixed length clamp rod 38, with an integral spring compensator to allow stretching under tension, on one side of the feed sleeve 28, and an actuated clamp rod 38 on the other.

To prepare for baling, the clamp cylinder 36 is positioned at its lowermost point of travel, causing the active clamp ring 33 to come out of contact with the fixed clamp ring 34. This permits a length of net tubing 32 to be withdrawn from its rucked position on the feed sleeve 28, slipped between the clamp rings 33 and 34, and slipped over a flared outlet end 41 of the feed sleeve 28. The net tubing 32 is then directed through a net gatherer 42 which is simply a crooke for pulling the net tubing toward the base 12. In the embodiment shown, the gatherer 42 is a flat plate 44 having a V-shaped cutout 46 for gathering the net tubing 32 into the point of the cutout 46 (see FIG. 4). The plate 44 is bolted or otherwise affixed to telescoping gatherer cylinders 48, which are firmly attached to the base 12, and are actuated by compressed air or the like. When the telescoping cylinders 48 are fully extended, the gatherer 42 does not interfere with the natural fall line of the net tubing 32, or items 22, dropped through the net tubing 32. When the gatherer cylinders 48 are actuated, the plate 44 draws the net tube 32 closer to the base 12, and the net tube 32 is constricted by the converging V-shaped cutout 46. The constriction of the net tube 32 positions it to be clinched closed with a suitable closure such as a wire loop. The closure point prevents items falling through the feed sleeve 28 from passing through the net tube 32. The closure of the net tube 32 is performed by a conventional stitching or clinching head 50, such as one of those manufactured by the New Jersey Stitching Machine Co., and having an integral cutter 52 for cutting the net, and a guide foot 54 for guiding the net into position for clinching and cutting. The clinching operation is typically actuated by an electric motor, shown diagrammatically as 56, which provides the power for cutting and bending a short segment of wire around the constricted net tube 32 in a loop, thus forming a closure. The clinching head 50 is mounted on a platform 58 by a pair of pivot pins 60 passing through tabs extending from the bottom of either side of the clincher head 50, and by a telescoping lift cylinder 62, which bears the weight of the front of the clincher head 50. The clincher head 50 can be pivoted upon the pivot pin 60 by the telescoping cylinder 62, and thus, the attitude of the clincher head 50, with respect to the platform 58, can be adjusted as desired. The platform 58 is pivotally mounted on legs 64, each of which is affixed to the platform 58 by an upper pivot pin 66 at one end, and to the base by a lower pivot pin 68 at the other end. A telescopic leg cylinder 70 controls the orientation of the legs 64, and thereby the position of the platform 58, and the clinching head 50. The clinching head 50 can thus be extended away from or towards the base 12 by the leg cylinder 70. An articulated forming cradle 72 is provided directly beneath the flared outlet 41 of the feed sleeve 28 for receiving the clinched net tube 32 as it is filled with items 22. The forming cradle 72 is pivotally mounted at the rear by tilt pivot pins 74 to a base platform 76. A telescoping tilt cylinder 78 supports the front of the forming cradle 72 and controls its attitude as it pivots upon the tilt pins 74. The base platform 76 is pivotally supported on a pivot rod 79 which extends transverse to the axis of tilt pivot pins 74. The base platform 76 includes a base crankpin 80 near its upper, side, rear surface, providing a point of attachment for a mating connecting rod 82 fitted at the other end thereof to a powered crank pin 84 extending from an eccentric 86. The eccentric 86 is rotated by a shaker motor 88. The forming cradle 72 is provided with a pair of hingedly connected doors 90. Only the flared upper edges 91 of the doors are visible in FIG. 1. The flared edges 91 guide the clinched net tube 32 and falling items 22 into the forming cradle 72. The doors 90 are operated by a pair of telescoping door cylinders 92, which alternately thrust open and close the doors. A kicker plate 93 is pivotally hung within the interior of the forming cradle 72 and is actuated by a kicker cylinder 94. The kicker plate 93 propels the contents of the forming cradle 72 out the open doors 90 and down an apron 96 which provides a gradual decline away from the forming cradle 72. A control panel 98 serves as a common housing for a counter 100, a programmable microprocessor controller with user interface 102, and a series of control buttons: start 104, cycle stop 106, step stop 108, and emergency stop 110, as well as, a manual-/automatic selector switch 112. An additional pair of switches is provided on the front of the control panel 98 for manually inducing clinching 114 and cutting 116. Of course, the aforesaid controls could be mounted in any convenient location which provides an operator with the necessary visualization of the device, while at the same time, isolating him from danger.

Figure 2:
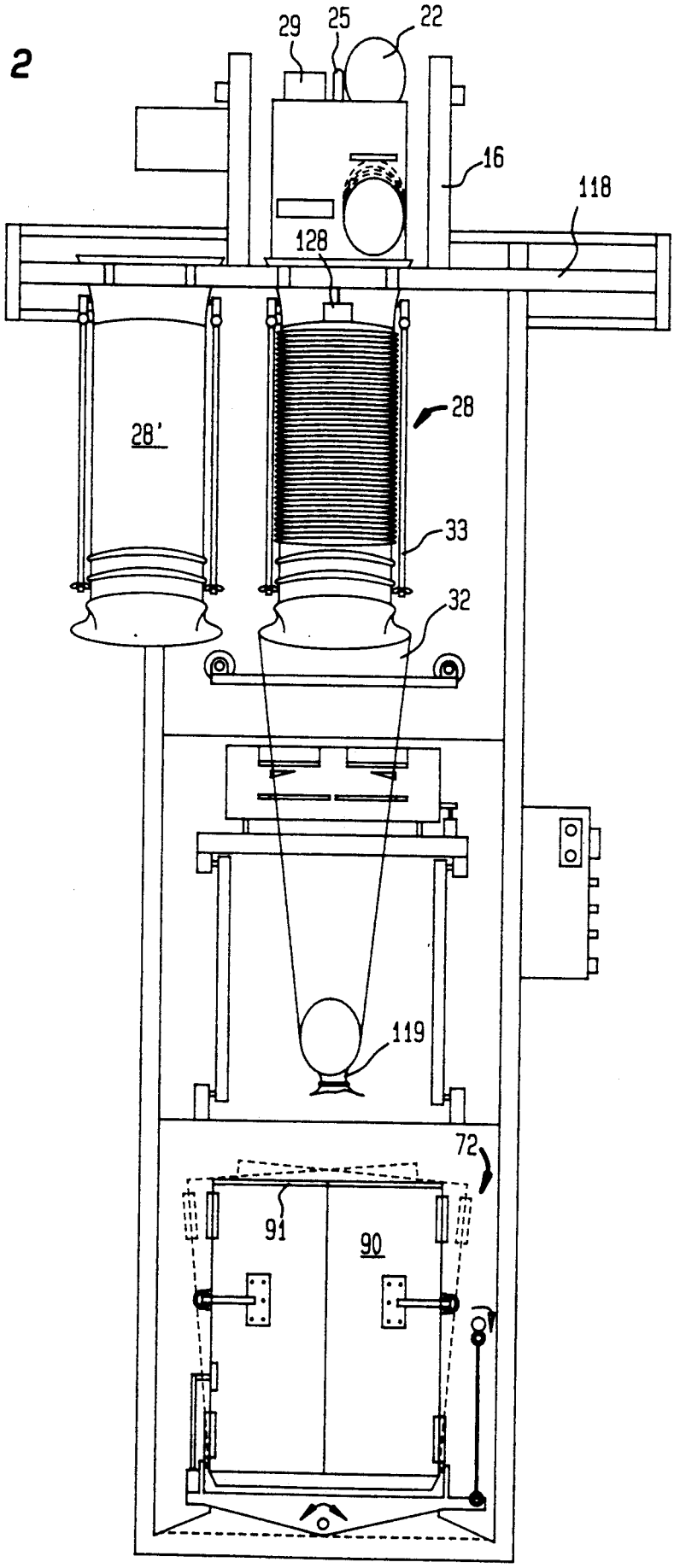
FIG. 2 is a front view in elevation of the device of FIG. 1 after deposition of a single item in the netting for forming a bale.

Referring now to FIG. 2, a front view of the device reveals dual, alternative, juxtaposed feed sleeves 28 and 28'. Feed sleeve 28 is shown suspended from slide bars 118 (only the front slide bar is visible in this view) in alignment with the inclined conveyor 16 and positioned to receive gravity fed items 22 for conducting them into the net tubing 32. The items 22 are carried up the inclined conveyor 16 by the staggered cleats 24 and partitioned by wall 25 to insure a sequential drop of individual units. An inactive feed sleeve 28', is also suspended on slide bars 118. This dual arrangement permits the removal of the inactive feed sleeve 28' and its reloading with a new rucked net tube 32 while the active sleeve 28 is being used. When the net tube 32 is exhausted from the active sleeve 28, the loaded inactive sleeve 28' can be rapidly substituted therefor merely by sliding it into position under the conveyor 16. The empty active sleeve 28 is thereby laterally displaced to an inactive position where it can be removed from the machine and loaded with a new supply of netting. An electrical lockout switch is provided which prevents the movement of the active clamp ring 33 when the feed sleeve 28 is shifted to an inactive position. The electrical lockout would prevent a worker from being accidentally pinched by the clamp ring 33 during the disassembly of the feed sleeve 28 from the baler 10. FIG. 2 further illustrates the position of the net tube 32 after formation of the sealed end 119, the first item 22 having fallen into what will become the bale. The position of the net tube 32 illustrated, is transitory, as the clamp rings 33 and 34 are not clamping the net tube 32 at this stage, and the clinched bottom is drawn by the inertia of the first and subsequent items 22, into the bottom of the oscillating forming cradle 72. Thus, with respect to the net tube 32 and the item 22 contained therein, this illustration is a stop-action image.

Figure 3:
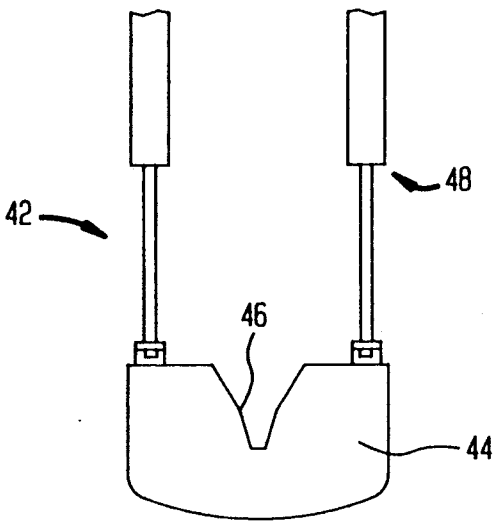
FIG. 3 is a fragmented top plan view of the gatherer portion of the device of FIGS. 1 and 2.
Figure 5A:
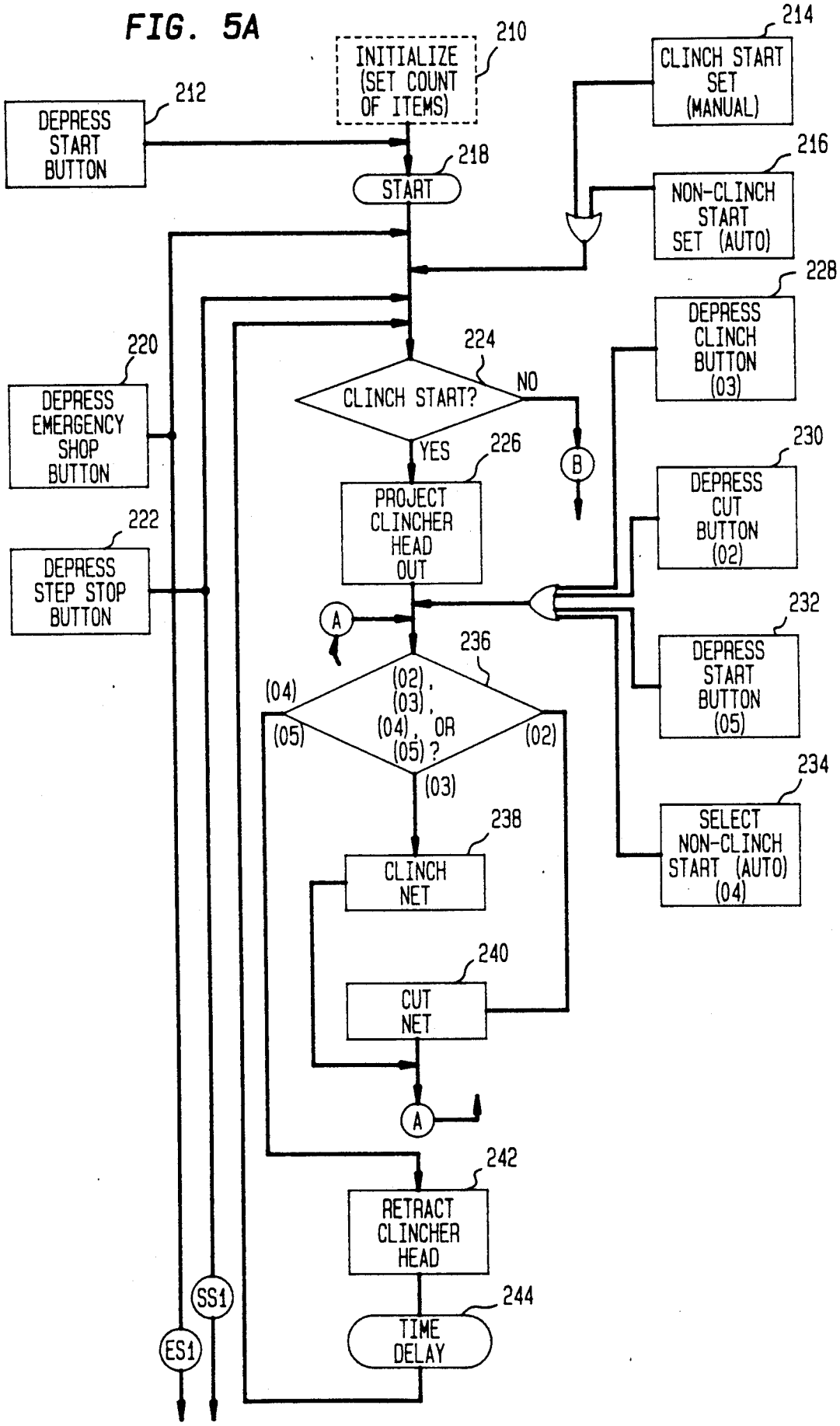
FIGS. 5A–5D show a flow chart of typical control logic for controlling the device.
Figure 5B:
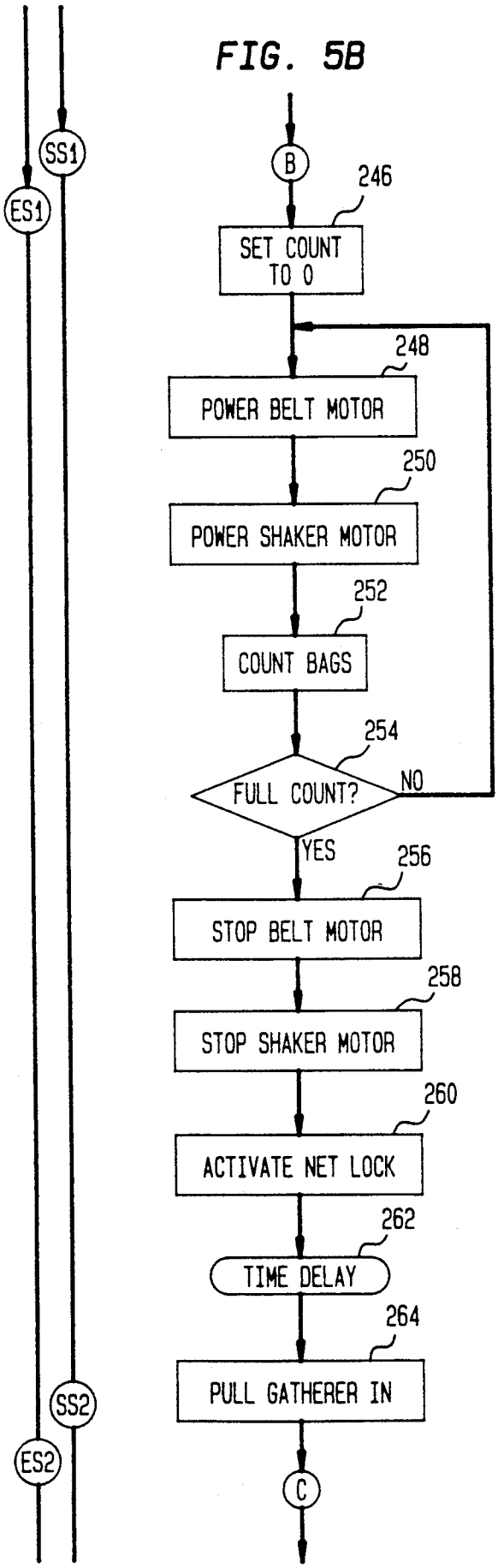
Figure 5C:
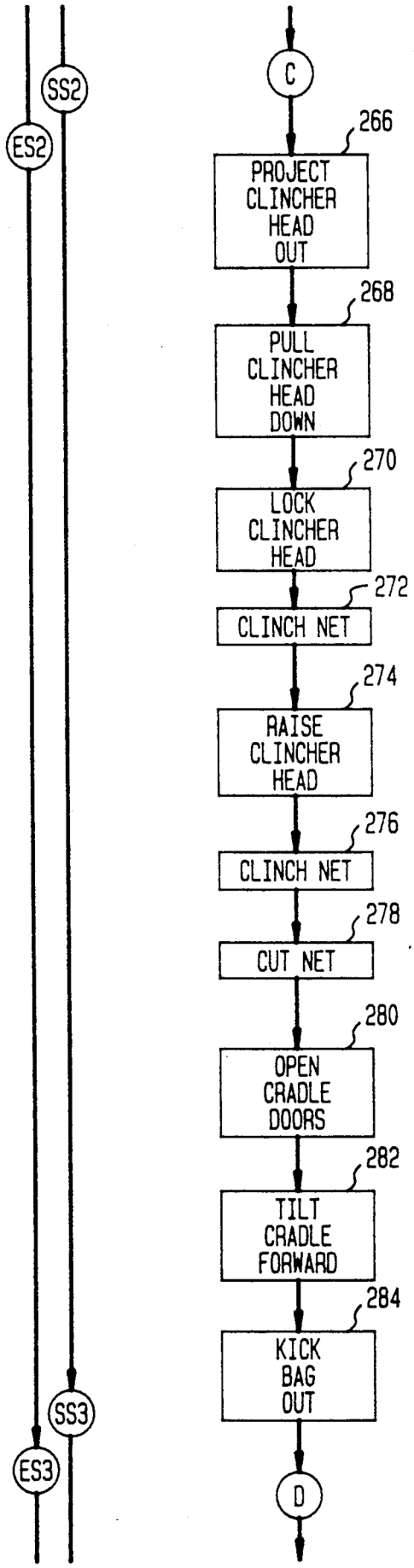
Figure 5D:
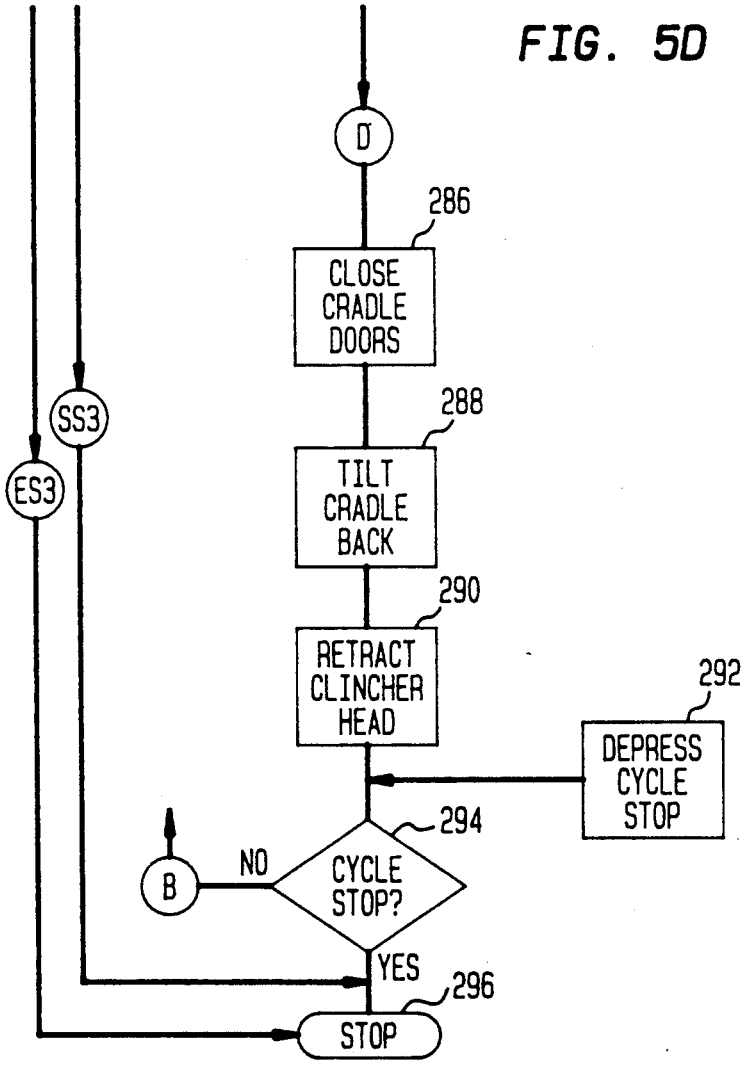

Referring now to FIG. 3, a top plan view of the gatherer 42, it can be seen that the preferred embodiment depicted includes a flat plate 44, having a V-shaped cutout 46, and is affixed to a pair of parallel telescoping gatherer cylinders 48 for selectively extending and retracting the plate 44.

Figure 4:
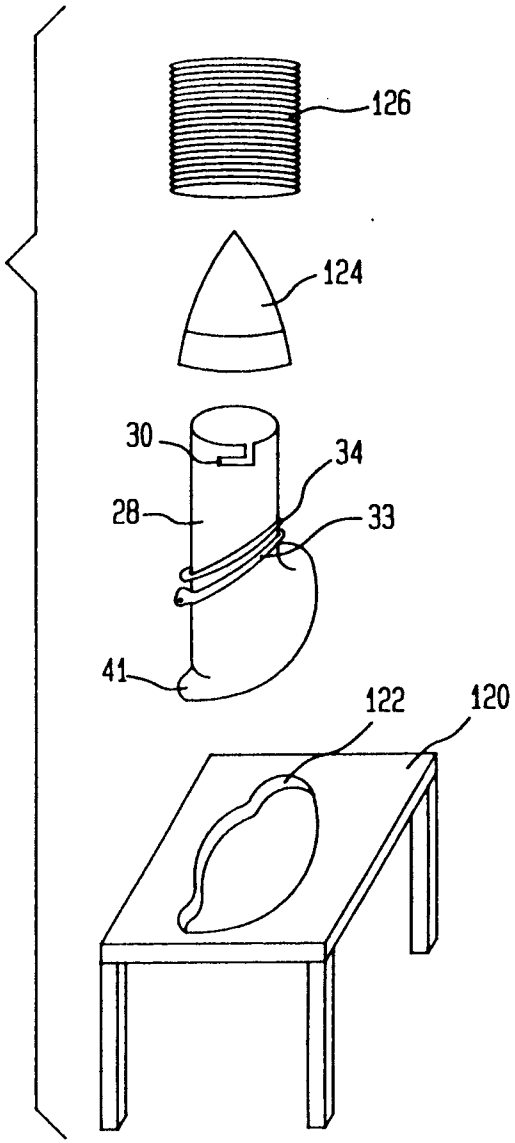
FIG. 4 is an exploded, perspective view of the feed sleeve portion of the device of FIGS. 1 and 2 being loaded with rucked netting via a support platform, a bullet-shaped adapter and a netting cartridge.

Referring to FIG. 4, a loading platform 120, with a feed sleeve cutout 122 matching the profile of the flared outlet end 41 of the feed sleeves 28, is supported on legs or other equivalent support, such as, by welding or bolting the platform 120 to the base 12 at a convenient location. The loading platform 120 receives and supports a feed sleeve 28 within the cutout 122. The active and fixed clamp rings 33 and 34, prevent the feed sleeve 28 from passing through the cutout 122, and support the feed sleeve 28 in an essentially upright position perpendicular to the loading platform 120. A bullet-shaped adapter 124 fits over the feed sleeve 28 to cover the keyway 30, and permits a net cartridge 126 to be slipped on the adapter 124. The net cartridge 126 is preferably a cardboard cylinder upon which a long tube of netting has been rucked. The cartridge 126 may be flattened to enhance ease of storage and transportation, and may also be provided with tear-off tabs which extend outwardly from the periphery of the open ends of the cardboard cylinder, thereby forming a retainer collar to prevent the rucked netting from inadvertently slipping off the cylinder while in transit, etc. The tabs may be ripped off after the net cartridge 126 has been placed on the adapter 124 to permit the netting to be slid from the cartridge into position on the feed sleeve 28.

The mechanical components of the present invention having been described, its operation will now be described in reference to FIGS. 5*a* -5*d*, which are a flow chart of typical control logic for controlling the device, and in further reference to FIGS. 1, 2 and 3.

Prior to starting the device for automatic baling, the microprocessor must be informed as to the desired count of items per bale (input 210). This number will vary upon the items baled and their size and weight. For example, it is likely desirable for a bale of 3 lb. onion bags to contain more individual bags of onions than a bale of 15 lb. potato bags. The program is started by depressing the start button 104 (step 212). As soon as the program is initiated, it is immediately subject to termination by a depression of the emergency stop button 110 (input 220). The emergency stop button 110 is always available to depower the baler 10 regardless of its existing state; this characteristic is depicted by the solid line flowing from input 220 parallel to the entire processing sequence ending at step 296 in FIG. 5(*d*). The step stop button 108 (input 222) terminates system operation after completion of the last command and, with this limitation, is available at all times. Due to the fact that a brief delay may exist between depression of the step stop button 108 and termination of operations, its constant, albeit delayed, availability is depicted by a dashed line in parallel with the entire sequence of commands. The manual/auto switch 112 may be placed either in manual mode (input 214) or in auto mode (input 216). Manual mode causes the clincher head 50 to be projected out (step 226) from the base 12, thereby allowing the net tube 32 to be manually positioned within the clincher head 50, whereupon the clincher head 50 may be fired by the operator's pressing the clinch button 114 (input 228). This allows a new net tube 32 to be clinched at the bottom before items 22 are dropped into it. The net tube 32 may also be cut under manual control by a depression of the cut button 116 (input 230). If the program is started with the manual/auto switch 112 in manual, (decision 224) it will remain in that state permitting manually induced clinching (step 238) and cutting (step 240) until the operator is satisfied with the results; at that time, he may place the manual/auto switch 112 in auto mode (input 234) and press the start button 104 (input 232), whereupon (decision 236) the clincher head 50 will be retracted (step 242), and the automatic baling process begun.

The beginning of automated baling is depicted in FIG. 5(*b*) with the initialization of the actual item count to zero (step 246). The inclined conveyor 16 and the forming cradle 72 are set in motion by energizing the belt motor and shaker motors (steps 248 and 250). Items 22, continuously supplied to the collection bin 20, either by manpower or a conveying belt or the like, are removed therefrom by the inclined conveyor 16 by means of the staggered cleats 24. As the items 22 reach the top of the conveyor 14, they interrupt a light beam projected and monitored by the optical sensor 29 and cooperating reflector 29, The interruption of the beam generates a signal to the counter 100 where the count is incremented. Upon passing beyond the top 14 of the inclined conveyor 16, the items 22 drop into the funnel shaped receiver 26, through the feed sleeve 28, and into the net tube 32, where they are confined by the sealed end 119. The active clamp ring 33 is, at this time, relaxed, so that upon the first item's 22 contacting the sealed end 119 of the net tube 32, its weight pulls a length of net tube 32 from the feed sleeve 28 sufficient to allow the item 22 to come to rest at the bottom of the oscillating forming cradle 72. The forming cradle 72 confines the net tube 32 and the items contained therein to a suitable shape and prevents the net tube from being overstressed, as might happen if the items 22 were to be dropped into an unsupported net tube 32. The shaker motor 88 acting through the eccentric 86, connecting rod 82 and crank pins 80 and 84, oscillates the base platform 76 causing a corresponding movement of the forming cradle 72, and inducing a gentle packing of the items 22 coming to rest within the cradle 72. The shaking of the forming cradle 72 permits the items 22 to seek their lowest level thus distributing the items to provide more efficient packing. Upon reaching the set count (decision 254), the counter 100 sends a full count signal to the microprocessor 102 whereupon the conveyor 16 and shaker 88 motors are stopped (steps 256 and 258). The active clamp ring 33 is then pulled upwards against the fixed clamp ring 34 by the clamp cylinders 36 under computer control (step 260). The gatherer 42 is pulled in towards the base by gather cylinders 48 thus pulling the net closer to the clinching head, while same time, constricting it within the V-shaped cutout, and causing the netting to be placed under the tensioning weight of the bale load (step 264). It should be noted that a convenient method of providing computer control over the various telescopic cylinders included in the present device is to utilize a bank of electrically controlled valves which control communication of the various cylinders with a common source of pressurized hydraulic fluid or compressed air. Referring to FIG. 5(*c*), the clincher head 50 is now projected outwards by activation of leg cylinder 70 (step 266). As the clincher head 50 approaches the gathered net tube 32, the tube slides between the V-shaped projections making up a conventional guide foot 54, further constricting the net at the point of its insertion into the guide foot 54. When the clincher head 50 reaches its fully extended position, lift cylinder 62 is actuated in a downward direction, causing the clincher head 50 to be tilted down toward the items 22 contained within the net tube 32. It is preferred that the item count be selected, and the space between the clincher head 50 and the top of the forming cradle 72, as well as, the diameter of the net tube 32, be dimentioned, such that when the clincher head 50 is pulled downward by lift cylinder 62 (step 268), the items 22 within the net tube 32 are contacted slightly by the clincher head 50 which, through the downward movement, stretches the net tube 32 and packs the items 22 more tightly. Having reached the desired downward travel, the clincher head 50 is held in place (step 270), while the clincher 50 is fired, thereby forming a seal on the net tube 32 which constitutes the top of the new bale (step 272). The clincher head 50 is then raised by lift cylinder 62 (step 274) and the clincher 50 fired (step 276) so that an additional seal is applied to the net tube 32, the additional seal forming the bottom of the next bale (the sealed end 119). The netting is then cut by the cutter 52 (step 278) between the two seals. The new bale having been sealed and cut from the net tube 32, the cradle doors 90 are opened by door cylinders 92 (step 280), the cradle 72 tilted forward by tilt cylinder 78 (step 282), and the bale kicked out the doors 90 by activation of the kicker cylinder 94 (step 284). The doors 90 are then closed by door cylinders 92 (step 286), the cradle 72 tilted back by tilt cylinder 78 (step 288), and the clincher head 50 is retracted (step 290) to make way for the next item 22 that is dropped into the net tube 32. The cycle stop button 106 may be pushed at any time during the operation of the device (input 292); it will stop the baler 10, however, only at the end of a cycle, ie., when the baling in progress at the time the button is depressed is completed, ie. at the end of step 290. If the cycle stop button 106 has not been depressed (decision 294), the automatic baling will continue until the net tube 32 is exhausted from the feed sleeve 28 or the task is completed. The device depicted in FIG. 1 includes a hook 128 for retaining a string running from the end of the rucked net tube 32 for preventing the net tube 32 from being inadvertently pulled from the feed sleeve 28. The hook 128 may be replaced with a switch which similarly receives the string, but that also generates a step stop signal (input 222) to the microprocessor 102 upon the net tube 32 being exhausted.

Thus, what has been described is an automated baling machine for baling a plurality of individual items into a large bale for shipping and/or storage. The baler described requires little human supervision and labor while at the same time accomplishing the task quickly and dependably.

It should be understood that the embodiments described herein are merely exemplary and that a person skilled in the art may make many variations and modifications without departing from the spirit and scope of the invention as defined in the appended claims.

We claim:

1. A device for baling a plurality of items in a sack-like bale formed from a tube of flexible material sealed at one end to yield a sock-like item receptacle which is filled with a selected number of said items, additionally sealed distal to said sealed end to enclose said items, and the resultant said bale cut from the remainder of said tube, comprising:

A. conduit means for conducting said plurality of items from an inlet at one end of said conduit means to an outlet at the other end, said tube being coaxially mountable on an outer surface of said conduit means, said sealed end situated below said outlet for capturing within said sock-like item receptacle said items passing through said outlet;

B. dispenser control means having a locked and an unlocked position for selectively dispensing a length of said tube when in the unlocked position; and C. base means for holding said conduit means.

2. A device in accordance with claim 1, wherein a portion of said tube distal to said sealed end is compressed along its longitudinal axis in an accordion-like gather and said dispenser control means are disposed between said compressed portion and said sealed end.

3. A device in accordance with claim 2, further comprising crooke means affixed to and projecting from said base means for selectively drawing said tube towards said base means and simultaneously constricting said tube in a plane perpendicular to its longitudinal axis where said crooke contacts said tube.

4. A device in accordance with claim 3 wherein the weight and inertia of said items conducted through said outlet constitute dispensing forces sufficient to cause said length of said tube to be withdrawn from said conduit means when said dispenser means is in the unlocked position, said dispensing causing a partial decompression of said gathered portion of said tube proximate said sealed end and the lowering of said sealed end through the plane in which said crooke means projects.

5. A device in accordance with claim 4, further comprising sealing means for performing said additional sealing, cutter means for cutting said bale from said remainder of said tube, and guide means having a converging slot therein for receiving and further constricting said tube prior to said additional sealing and cutting.

6. A device in accordance with claim 5, wherein said sealing means, said guide means and said cutter means are carried on retractably projectible platform means for projecting and retracting said sealing means, said guide means and said cutter means to a first position proximate said tube and to a second position distal to said tube.

7. A device in accordance with claim 6, further comprising elevation means for elevating and deelevating said sealing means, said guide means and said cutting means to a first and a second selected height relative to said platform means, said guide means when passing from said first position and said first selected height to said second position and said second selected height engaging said items within said sock-like receptacle, stretching said tube between said dispenser means in the locked position and said guide means, and packing said items in said receptacle.

8. A device in accordance with claim 7, further comprising cradle means having sidewalls, a bottom and an open top for receiving and supporting said sealed one end of said sock-like item receptacle while said sock-like item receptacle is filled with a selected number of said items, said receptacle being restricted from expanding circumferentially as it is filled with said items by said side walls of said cradle means.

9. A device in accordance with claim 8, further comprising shaker means for shaking said cradle means while said sock-like item receptacle is filled with a selected number of said items, said shaker means inducing a settling of said items within said sock-like item receptacle.

10. A device for baling a plurality of items in a sack-like bale formed from a tube of flexible material sealed at one end to yield a sock-like item receptacle which is filled with a selected number of said items, additionally sealed distal to said sealed end to enclose said items, and the resultant said bale cut from the remainder of said tube, comprising:

A. conduit means for conducting said plurality of items from an inlet at one end of said conduit means to an outlet at the other end, said tube being coaxially mountable on an outer surface of said conduit means, a portion of said tube distal to said sealed end being compressed along its longitudinal axis in an accordion-like gather, said sealed end situated below said outlet for capturing within said sock-like item receptacle said items passing through said outlet;

B. dispenser control means for selectively dispensing a length of said tube disposed between said compressed portion and said sealed end;

C. base means for holding said conduit means;

D. crooke means affixed to and projecting from said base means for selectively drawing said tube towards said base means and simultaneously constricting said tube in a plane perpendicular to its longitudinal axis where said crooke contacts said tube, the weight and inertia of said items conducted through said outlet constituting dispensing forces sufficient to cause said length of said tube to be withdrawn from said conduit means, said dispensing causing a partial decompression of said gathered portion of said tube proximate said sealed end and the lowering of said sealed end through the plane in which said crooke means projects;

E. sealing means for performing said additional sealing;

F. cutter means for cutting said bale from said remainder of said tube;

G. retractably projectible platform means for carrying and projecting and retracting said sealing means and said cutter means towards and away from said tube;

H. elevation means for elevating said sealing and said cutting means to a selected height relative to said platform means;

I. cradle means for receiving and supporting said sealed one end of said sock-like item receptacle while said sock-like item receptacle is filled with a selected number of said items; and J. shaker means for shaking said cradle means while said sock-like item receptacle is filled with a selected number of said items, said shaker means inducing a settling of said items within said sock-like item receptacle.

11. A device in accordance with claim 10, further comprising feed means to provide a controlled feeding of said plurality of items to said inlet end of said conduit means.

12. A device in accordance with claim 11, further comprising alternate conduit means virtually identical to said conduit means, said alternate conduit means and said conduit means mounted on said base via slidebar means to permit a mutually exclusive substitution of one for the other for conducting said items into an associated said sock-like receptacle.

13. A device in accordance with claim 12, further including bin means for holding a plurality of said items, said feed means having access to said bin means and said items held therein for transporting said items from said bin means to said inlet end of said conduit.

14. A device in accordance with claim 13, wherein said dispensing means includes a first ring rigidly affixed to and projecting from said exterior surface of said conduit means intermediate said compressed portion and said outlet end, a second ring having an interior radius exceeding the external diameter of said conduit means slideably disposed about said conduit means between said first ring and said outlet end, puller bar means removeably attached to said second ring and extending therefrom to puller means for pulling said puller bar means and said second ring towards said first ring.

15. A device in accordance with claim 14, wherein said dispensing means includes a pair of said puller bar means and associated said puller means and said tube is threaded over said first ring and between the exterior surface of said conduit means and the interior radius of said second ring, said tube being clamped between said first and said second ring when said puller means are activated.

16. A device in accordance with claim 15, wherein said feed means is a conveyor having a continuous belt with a plurality of cleats in two parallel staggered rows separated by a wall member, said cleats extending from the surface of said belt for engaging and transporting said plurality of items from said bin means to said inlet end.

17. A device in accordance with claim 16 wherein said conduit and said alternate conduit are each removeable from said base means to permit said tube to be installed thereon, either of said conduits being removeable while the other is receiving items from said feed means.

18. A device in accordance with claim 17 wherein said inlet end of said conduit has an inwardly tapering funnel shape for enhancing the reception of items from said feed means and said outlet end is flared radially outward for expanding the diameter of said tube passing thereover.

19. A device in accordance with claim 18, further comprising digital controller means for controlling said dispenser control means, said crooke means, said sealing means, said cutter means, said platform means, said cradle means, said shaker means and said feed means.

20. A device in accordance with claim 19, further comprising item sensor means disposed proximate said inlet end for sensing the passage of an item into said inlet end and conveying a signal in response thereto to said digital controller means.

21. A device in accordance with claim 20, wherein said cradle means includes door means for conducting said bale out of said cradle means, tilt means for tilting said bin means to induce said bale to slide toward said door means and kicker means for propelling said bale out said door means.

22. A device in accordance with claim 21, wherein said tube is flexible plastic netting.

23. A device in accordance with claim 17, further comprising

A. loading platform means having a cutout for receiving and supporting said conduit means therein;

B. bullet-shaped adapter means for temporarily affixing to and covering said inlet end and for receiving thereover;

C. tube cartridge means having a said tube compressed longitudinally in an accordion-like gather disposed about the exterior surface thereof, said tube being ejectable from said cartridge over said adapter and onto said conduit.

24. A method for automatically baling a plurality of items into a bale formed from a tube of flexible material utilizing a device having conduit means for conducting said plurality of items from an inlet at one end of said conduit means to an outlet at the other end, said tube being coaxially mountable on an outer surface of said conduit means, dispenser control means having a locked and an unlocked position for selectively dispensing a length of said tube when in the unlocked position, and base means for holding said conduit means, comprises the steps of:

A. coaxially mounting said tube about the outer surface of said conduit means;

B. dispensing a selected length of said tube under the control of said dispenser control means such that a free end of said tube extends beyond said outlet end of said conduit means;

C. sealing said free end to form a sock-like item receptacle;

D. depositing a selected number of said items in said inlet;

E. capturing said items passing through said conduit means and out said outlet within said sock-like receptacle;

F. additionally sealing said tube at a position along the length of said tube proximate to said captured items and distal to said sealed free end to form said bale; and G. cutting said tube immediately above said additional seal to free said bale from the remainder of said tube.

25. A method in accordance with claim 24, wherein said step of coaxially mounting includes mounting a portion of said tube which is compressed along its longitudinal axis in an accordion-like gather and wherein said dispenser control means are disposed between said compressed portion and said sealed end.

26. A method in accordance with claim 25, wherein said device includes crooke means affixed to and projecting from said base means for selectively drawing said tube towards said base means and simultaneously constricting said tube in a plane perpendicular to its longitudinal axis where said crooke means contacts said tube, and wherein the weight and inertia of said items conducted through said outlet constitute dispensing forces sufficient to cause said length of said tube to be withdrawn from said conduit means when said dispenser means is in the unlocked position, said dispensing causing a partial decompression of said gathered portion of said tube proximate said sealed end and the lowering of said sealed end through the plane in which said crooke means projects, and further comprising the steps of unlocking said dispenser control means and further dispensing a selective length of said tube in response to the weight and inertia of said items dispensed from said outlet such that said sealed end is lowered through the plane of said crooke.

27. A method in accordance with claim 26, wherein said device includes sealing means for performing said step of additionally sealing and cutter means for performing said step of cutting said bale from said remainder of said tube and further including the steps of locking said dispenser means then simultaneously constricting and drawing said tube towards said base means, said sealing means, and said cutter means, with said crook means, after said step of further dispensing, and prior to said step of additionally sealing.

28. A method in accordance with claim 27, wherein said device includes guide means having a converging slot therein for receiving and further constricting said tube and wherein said sealing means, said guide means and said cutter means are carried on retractably projectible platform means for projecting and retracting said sealing means, said guide means and said cutter means to a first position proximate said tube and to a second position distal to said tube and further comprising the steps of projecting said sealing means, said guide means and said cutter means to said first position, receiving said tube in said converging slot and further constricting said tube prior to said step of additionally sealing and retracting said sealing means, said guide means and said cutting means to said second position after said step of cutting.

29. A method in accordance with claim 28, wherein said device includes elevation means for elevating and deelevating said sealing means, said guide means and said cutting means to a first and a second selected height relative to said platform means and further comprising the steps of A. elevating said sealing means, said guide means and said cutting means to said first selected height prior to said step of projecting;

B. deelevating said sealing means, said guide means and said cutting means after said step of projecting but prior to said step of additionally sealing, said guide means engaging said items within said sock-like receptacle and stretching said tube between said locked dispenser means and said guide means packing said items in said receptacle;

C. elevating said sealing means and cutting means after said step of additionally sealing; and D. bottom sealing said tube prior to said step of cutting to provide a new end seal;

E. repeating said steps D, E, F, and G of claim 23.

30. A method in accordance with claim 29, wherein said device includes cradle means for receiving and supporting said sealed one end of said sock-like item receptacle while said sock-like item receptacle is filled with a selected number of said items, and shaker means for shaking said cradle means during said filling, and further comprising the steps of A. receiving said sock-like item receptacle within said cradle means after said step of further dispensing; and B. shaking said cradle means during said step of capturing to promote the settling of said items within said sock-like item receptacle.

31. A method in accordance with claim 30, wherein said device includes bin means for holding a plurality of said items, and feed means having access to said bin means and said items held therein for transporting said items from said bin means to said inlet end of said conduit means to provide a controlled feeding of said items to said inlet end, further comprising the step of transporting said items from said bin means via said feed means to said inlet prior to said step of depositing and wherein said step of depositing is performed by said feed means.

32. A method in accordance with claim 31, wherein said device includes alternate conduit means virtually identical to said conduit means, said alternate conduit means and said conduit means mounted on said base via slidebar means to permit a mutually exclusive substitution of one for the other for conducting said items into an associated said sock-like receptacle, said conduit and said alternate conduit each removeable from said base means to permit said tube to be installed thereon, either of said conduits being removeable while the other is receiving items from said feed means and further comprising the steps of:

A. coaxially mounting an alternate said tube about the outer surface of said alternate conduit means;

B. interrupting said repeated steps called for in said step C of claim 29 when said tube is exhausted from said conduit;

C. substituting said alternate conduit for said conduit;

D. preparing said alternate tube for baling by performing steps A, B, and C of claim 24;

E. reinvoking said repeated steps called for in step C of claim 29;

F. reidentifying said alternate conduit and said alternate tube as said conduit and said tube;

G. further reidentifying what was previously considered said conduit and said tube as said alternate conduit and said alternate tube;

H. Repeating steps A through G herein until the baling operation is done.

33. A method in accordance with claim 32, wherein said dispensing means includes a first ring rigidly affixed to and projecting from said exterior surface of said conduit means intermediate said compressed portion and said outlet end, a second ring having an interior radius exceeding the external diameter of said conduit means slideably disposed about said conduit means between said first ring and said outlet end, puller bar means removeably attached to said second ring and extending therefrom to puller means for pulling said puller bar means and said second ring towards said first ring, said tube threaded over said first ring and between the exterior surface of said conduit means and the interior radius of said second ring, said tube being clamped between said first and said second ring when said puller means are activated, further comprising the step of clamping said tube between said first and second rings prior to said steps of simultaneously drawing and constricting.

34. A device in accordance with claim 33, wherein said feed means is a conveyor having a continuous belt with a plurality of cleats in two parallel staggered rows separated by a wall member, said cleats extending from the surface of said belt for engaging and sequentially transporting said plurality of items from said bin means to said inlet end, and wherein said device includes item sensor means disposed proximate said inlet end for sensing the passage of an item into said inlet end and conveying a signal in response thereto to digital controller means, said digital controller means maintaining a count of said items which is compared to a selected set count of items to be contained in a single said bale, said digital controller means controlling said dispenser control means, said crooke means, said sealing means, said cutter means, said platform means, said cradle means, said shaker means and said feed means, and wherein each of said steps of the method set forth in this claim is sequenced and controlled by said digital controller means and further comprising the steps of A. counting said items as said items enter said inlet;

B. comparing said count of items with a predetermined count; and

C. stopping said feed means upon said count of items reaching said predetermined count prior to said steps of simultaneously drawing and constricting.

35. A method in accordance with claim 34, wherein said cradle means includes door means for conducting said bale out of said cradle means, tilt means for tilting said bin means to induce said bale to slide toward said door means and kicker means for propelling said bale out said door means and further comprising the steps of A. stopping said cradle means shaking;

B. tilting said cradle means via said tilt means thereby inducing said bale to tilt towards said door means; and C. firing said kicker means thereby propelling said bale out said door means, all of said steps A through C herein occurring after said step of cutting.

36. A method in accordance with claim 35, wherein said device includes conduit loading platform means having a cutout for receiving and supporting said conduit means therein, bullet-shaped adapter means for temporarily affixing to and covering said inlet end and for receiving thereover tube cartridge means having a said tube compressed longitudinally in an accordion-like gather disposed about the exterior surface of said cartridge, said tube being ejectable from said cartridge over said adapter and onto said conduit, and wherein said step of coaxially mounting includes A. inserting said outlet end of said conduit means through said cutout, said platform supporting said conduit in a substantially upright position;

B. placing said bullet-shaped adapter over said inlet end of said tube;

C. installing said cartridge over said adapter;

D. sliding said compressed tube from said cartridge over said adapter onto said conduit.

* * * * *